United States Patent [19]

Tillbrook

[11] Patent Number: 4,494,246

[45] Date of Patent: Jan. 22, 1985

[54] PROTECTIVE CLOTHING

[76] Inventor: Anthony A. C. Tillbrook, Hillair, Coopersale La., Theydon Garnon, Epping, Essex, England

[21] Appl. No.: 381,558

[22] Filed: May 24, 1982

[30] Foreign Application Priority Data

May 27, 1981 [GB] United Kingdom ..... 8116186
Sep. 9, 1981 [GB] United Kingdom ..... 8127200
Dec. 7, 1981 [GB] United Kingdom ..... 8136787

[51] Int. Cl.[3] ..... A62B 17/00; B63C 11/04
[52] U.S. Cl. ..... 2/2.1 R
[58] Field of Search ..... 2/2.1 R, 269, 2, 65

[56] References Cited

U.S. PATENT DOCUMENTS 1,626,136 4/1927 Hart ..... 2/65
3,925,839 12/1975 Smith ..... 2/2.1 R
4,117,552 10/1978 Simpson ..... 2/269

OTHER PUBLICATIONS

Gore Tex Publication, pp. 1-8.

*Primary Examiner*—Doris L. Troutman
*Attorney, Agent, or Firm*—Wigman & Cohen

[57] ABSTRACT

This invention relates to garments for protecting the wearer from cold during aquatic sports such as windsurfing. For various reasons neither the conventional wet suit nor any conventional dry suit may be described totally satisfactory for windsurfing. It is essential to retain considerable freedom of arm movement and also to keep a stylish appearance, particularly for competitive work. To meet these conflicting requirements, there is provided a one piece garment in which leg portions 2 and a body portion 1 are of expanded rubber and close fitting, while the arm portions 3 are of loose fitting waterproof material giving freedom for the arms but providing less thermal insulation.

6 Claims, 5 Drawing Figures

PROTECTIVE CLOTHING

This invention relates to protective clothing. While the protective clothing according to the invention is primarily designed for use when windsurfing, and will be primarily described in connection with that activity, it will be understood that it is also usable for other aquatic activities such as sailing.

It will be understood that windsurfing is a sport in which the expert hopes to avoid immersion but it is an ever-present risk, so that, particularly in cold weather, protective garments are normally worn.

Windsurfing garments have been adapted from diving suits which fall into two basic categories, namely dry suits and wet suits.

Dry suits are the oldest form of diver's suit. The original type was known as the 'standard' suit and was made from a heavy duty, non-flexible, non-insulating canvas type material. Insuation was obtained from air supplied to the inside of the suit from the surface via a hose connected to the helmet. Additional insulation was gained by wearing thermal type undergear. These suits were worn very loose.

Later dry suits were made of a lighter, rubberized material which was slightly flexible but non-insulating, and insulation was also obtained by air being supplied to the inside of the suit, usually derived from the diver's own air supply. This type of suit is also worn loose. Thermal underwear is normally worn.

The wet suit is made from expanded neoprene and the air cells of the material give excellent insulation. This type of suit is worn tight to the user's body to minimize the flow of water within the suit and no additional air is supplied, nor is underwear normally worn. Only limited quantities of water can flow between the suit and the wearer's body and soon warm to body temperature. However, when the user leaves the water, particuarly in windy conditions, chilling is quite rapid so a wet suit is not very suitable for windsurfing.

There also exists a type of suit made from expanded neoprene as used in wet suits but made dry. The advantages of the combination is that it increases the insulation over the normal dry suit and is considerably more comfortable to wear. It is usual practice to supply air to the inside of these suits from the diver's air supply, and to wear thermal underwear in cold weather. This type of suit is worn rather looser than a wet suit, but tighter than the standard dry suit or the lighter dry suit described above.

The lighter weight dry suit has been adapted for cold weather use by windsurfers by omitting the air supply, which is not necessary as adequate air is trapped inside the suit when dressing and this air is not compressed in normal use as the suit is used on and mainly above the surface of the water. Underwear is also normally worn for insulation. A particular disadvantage of this type of suit when used for windsurfing is that it is bulky and cumbersome, and a windsurfer in order to practice his sport needs as much freedom of movement as can be obtained. Furthermore, if a windsurfer should fall into the water, large volumes of air inside his suit can cause difficulties in maneuvering. Also windsurfing is a sport where style plays an important role. This style needs to be observed by judges of competitions and such dry suits handicap the user in view of the possible prejudice engendered by the lack of aesthetic appeal of a large and shapeless suit.

Wet suits are widely used for windsurfing for warm weather use, as the material, being insulating, does not rely on thermal underwear, and the suit can be worn more tightly, and therefore is more stylish. A disadvantage of this type of suit is that in colder weather the exchange of water inside the suit and the wind factor, quickly chill the user, and also the tight fit necessary in order to minimize this problem can seriously restrict the circulation in the user's arms, impeding his ability to windsurf. To overcome this, the arms may be provided with vents, closable by suitable fasteners, to relieve cramps. However, should the user fall in with the vents open, a large amount of water is let in, which is uncomfortable and may be dangerous.

There exist wet suits developed with voluminous, and therefore substantially non-insulating, sleeves to overcome the problem of circulation restriction of the arms, but these are regarded as summer garments as the amount of water and cold air that flows inside the sleeve, render this type of garment impractical for cold weather use.

There exist dry suits made from expanded neoprene, for windsurfing, but these are regarded as impractical as the tight sleeve restricts the blood circulation in the arm. Since closable vents are not practicable, ventilation is difficult and this type of garment is not widely acceptable.

It will be appreciated that windsurfing is a strenuous sport and it places particular strain on the arms, so that if a suit restricting the blood circulation in the arms is worn, cramps may ensue, and therefore the required sustained effort may not be achievable.

According to the present invention there is provided a suit for use in aquatic sports, particularly windsurfing, comprising a one piece garment to cover the legs, arms and body, in which the leg portions and at least the lower part of the body portion are made of a flexible, expanded rubber or rubber-like material arranged to fit closely to the users legs and body, and in which the arm portions are made of a waterproof fabric and adapted to be loose fitting.

If desired, an upper part of the body portion may also be of loose fitting waterproof fabric.

While being loose fitting, the fabric arm portions are not bulky and therefore do not significantly detract from the wearer's appearance from a stylistic point of view and do not restrict blood circulation in the arms. Also air in the body portion of the suit may travel into the arm portions and provide for some insulation and warming of the arms.

Preferably, the waterproof arm portions (or sleeves) are made of a breathable waterproof material, e.g. that sold under the Trade name "Goretex".

In extreme climatic conditions it is possible for the suit to be worn with separate warm clothing inside, such as thermal underwear. The breathing of the arm portions or sleeves avoids this clothing becoming uncomfortably soaked in perspiration. It also acts as ventilation for the whole suit.

For wind surfing, since no substantial periods of immersion are envisaged, no helmet is normally worn so a neck seal has to be provided to prevent ingress of water into the suit.

A normal technique for doing this is the provision of a neck band of thin stretchable rubber or rubber-like material which fits snugly round the wearer's neck and is fitted in the suit. Unfortunately, although being both reliable as a seal and comfortable and smart to wear, this type of seal allows substantial heat loss because of the use of non-insulating material.

In accordance with a preferred form of the present invention, the protective suit or garment has a neck aperture adapted to expand so that the garment can be pulled over the wearer's head, and the neck aperture is provided with a sealing neck band of thin stretchable rubber or rubber-like material and surrounded by a collar secured to the suit or garment and of insulating material, the said collar being provided with a closure member to enable the collar to be drawn in snugly to the wearer's neck outside the neck band.

The invention will be further described with reference to the accompanying drawings, in which.

Figure 1:
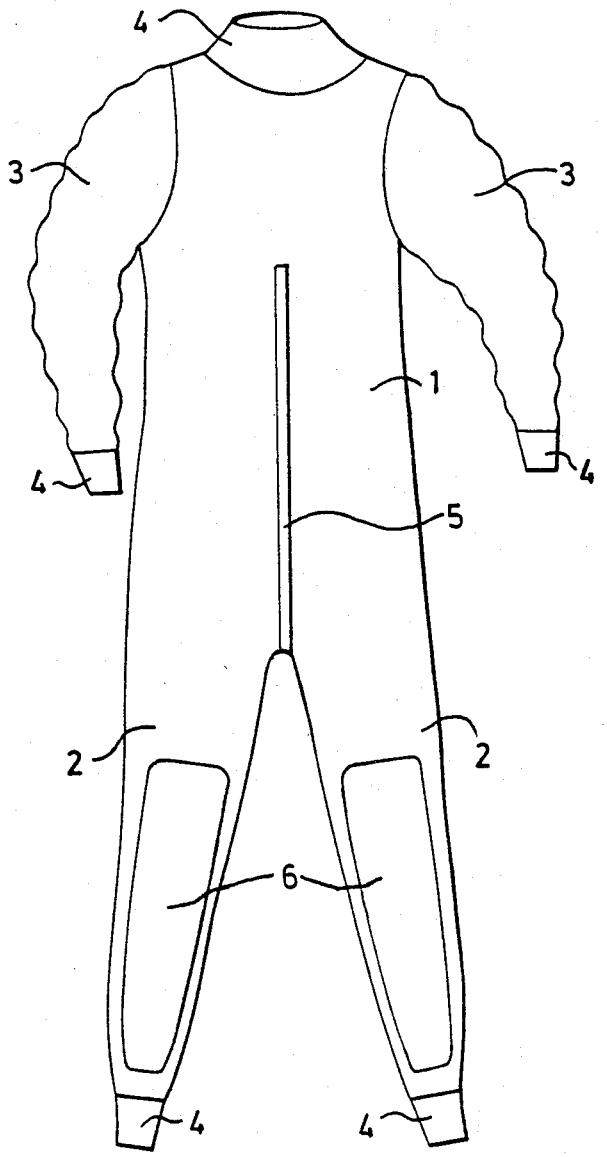
FIG. 1 illustrates diagrammatically a form of protective garment in accordance with the invention.

As shown in FIG. 1, the garment has unitary torso and leg portions 1 and 2 respectively, made in approximately 3 mm. expanded neoprene or similar material, lined either one or both sides with a synthetic stretch fabric, such as nylon or lycra. Seams are joined with a waterproof adhesive and are stitched in such a manner that the stitch holes do not penetrate the material. Alternatively, the seams may be taped with a fabric of rubberized, glued or heat-sealed tape.

Sleeves 3 of a top section of the suit, are made loose so as not to restrict the user's arm circulation. They are of a synthetic lightweight fabric such as nylon, waterproofed and joined with adhesive or heat sealing. It is preferred to use a breathable waterproof material, e.g. that sold as "Goretex".

This particular material consists of a film of polytetrafluorethylene covered on each side with a layer of nylon fabric. The breathability of the fabric is a particular advantage in warm weather conditions as it allows ventilation of the suit to prevent uncomfortable build up of perspiration beneath the suit, but without being permeable to liquid water.

Seals 4 are fitted to the neck, wrists and ankles to render the garment waterproof. Bootees may be fitted to the legs 2 of the suit in place of ankle seals.

Also, as a preferred alternative, the feet of the suit may be integral.

If a user wishes to use the suit without the feet, then they may be cut off. A seal at the ankle may then be achieved by turning the bottom of the leg up inside the suit so that the lining material is not exposed. A band placed around the outside of the leg at the position of the turn up will provide a clamp to complete the seal. A latex seal maybe fitted if desired.

Entry to the suit is made through a waterproof sliding clasp fastener of which the position is shown at 5. This fastener 5 extends from the front of the suit under the crutch and terminates at the back of the suit to minimize restriction of the user's movements, which could otherwise be experienced and also allows the user to relieve his wants of nature, without removing the complete suit. Other types of closure may be considered. In particular, it is simple to provide a fastener across the shoulders, and this type of closure is commonly used.

Knee pads and/or shin pads 6, may be fitted to strengthen the more vulnerable part of the suit from wear through kneeling.

A hood of expanded neoprene or waterproof fabric may be fitted.

In the alternative, a collar as shown in FIGS. 2 to 5 may be fitted.

Figure 2:
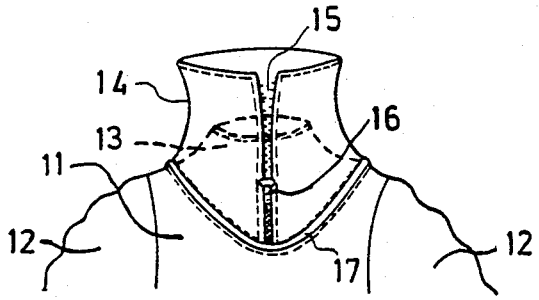
FIG. 2 is a view showing the upper part of suit or garment having a collar and showing the collar in one position.

Turning now to FIG. 2, there is shown the upper part of a suit similar to that of FIG. 1. There is shown a body portion 11, and parts of two sleeves 12. Also shown is a neck band 13 of a rubber or rubber-like material which is adapted to expand to pass over the wearer's head and then to fit snugly against his or her neck to act as a seal. It will be seen that the neck band 13 is of considerable width in order to provide the necessary scope for expansion, and therefore there is a potential for substantial heat loss through it. In order to minimize this heat loss there is provided a collar 14 having an opening 15 adapted to be closed by a sliding clasp fastener 16. The collar 14 is shown as being attached to the suit by stitching 17, and it will be seen that the provision of the opening 15 enables the narrow neck portion of the collar to expand to allow passage of the head.

Figure 3:
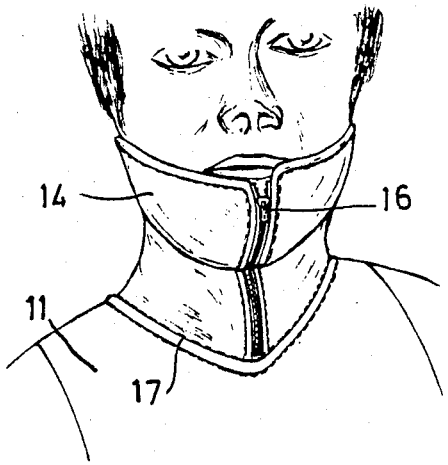
FIGS. 3, 4 and 5 show the suit and garment of FIG. 2 with the collar in alternative positions.

Once the wearer has the suit on, he may elect how to wear the collar. FIG. 3 shows the collar in the most effective cold weather position in which the sliding clasp fastener is merely pulled upwards to its fullest extent to close the opening 15 and to pull the collar snugly around the wearer's neck and chin.

Figure 4:
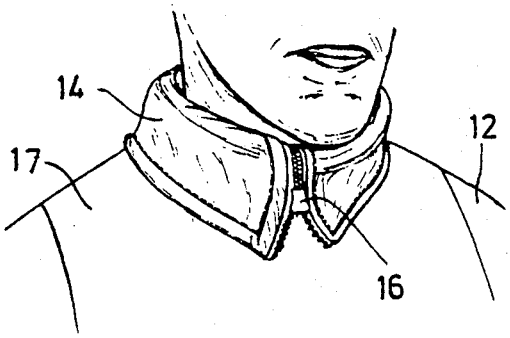

In the alternative position shown in FIG. 4, the collar is turned down and the sliding clasp fastener closed wholly on its lower part and partially on the original upper and now outer part of the collar. In this position there is still considerable insulation, although rather less than in the FIG. 3 position, but the appearance is rather better.

Figure 5:
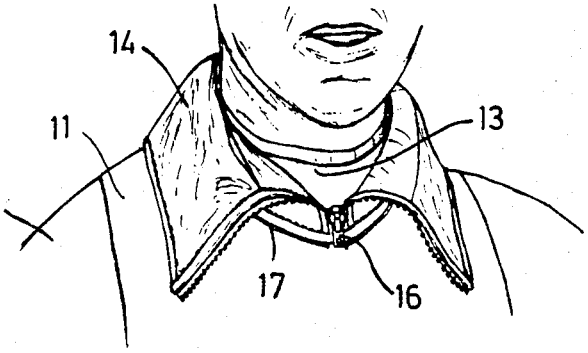

In the FIG. 5 position, the collar is turned down and the fastener is not fastened so that the collar appears as an open collar and the neck seal 13 is exposed. This is of course less insulating than either of the other positions but may be preferred in warm conditions.

I claim:

1. In a dry suit for use in aquatic sports, the suit being of the type comprising a one piece garment to cover the legs, arms and body of a user and having leg portions, a body portion, and arm portions, said suit being sealed against entry of water, the leg portions and at least the lower part of the body portion being made of a flexible, expanded rubber or rubber-like material arranged to fit closely to the user's legs and body; wherein the improvement comprises the arm portions being made of a thin and flexible waterproof fabric different from the said flexible expanded material and adapted to be loose fitting.

2. A suit as claimed in claim 1, in which the arm portions are made of a breathable fabric.

3. A suit as claimed in claim 1, in which the body portion has an upper part which is also of a loose fitting waterproof fabric.

4. A suit as claimed in claim 1, in which the expanded rubber or rubber-like material is lined with a synthetic stretch fabric.

5. A suit as claimed in claim 1, provided with a closure in the form of a sliding clasp fastener extending from the front of the body portion, under the crutch and terminating at the back of the body portion.

6. A suit as claimed in claim 1, having a neck aperture adapted to expand so that the garment can be pulled over the wearer's head, and in which the neck aperture is provided with a sealing neck band of thin stretchable rubber or rubber-like material, the suit further comprising a collar of insulating material secured to the suit and surrounding the neck band, the said collar being provided with a closure member to enable the collar to be drawn in snugly to the wearer's neck outside the neck band.

* * * * *